US005281054A

United States Patent [19]

O'Riordan

[11] Patent Number: 5,281,054

[45] Date of Patent: Jan. 25, 1994

[54] VIBRATORY PLOW ASSEMBLY

[76] Inventor: Michael O'Riordan, Mitchelsfort, Watergrasshill, County Cork, Ireland

[21] Appl. No.: 869,537

[22] Filed: Apr. 15, 1992

[30] Foreign Application Priority Data

Apr. 18, 1991 [IE] Ireland ..... 1291/91

[51] Int. Cl.[5] ..... E02F 5/10

[52] U.S. Cl. ..... 405/182; 405/183; 405/180

[58] Field of Search ..... 405/182, 183, 180, 177, 405/174; 37/98, DIG. 18

[56] References Cited

U.S. PATENT DOCUMENTS

| | | | |
|---|---|---|---|
| 3,948,329 | 4/1976 | Cummings . | |
| 4,040,261 | 8/1977 | Schuck et al. | 405/182 |
| 4,498,813 | 2/1985 | Nelson et al. | 405/182 |
| 4,867,607 | 9/1989 | Johnson et al. | 405/182 |
| 5,039,252 | 8/1991 | Schuermann | 405/182 |

FOREIGN PATENT DOCUMENTS

| | | |
|---|---|---|
| 9001831 | 3/1992 | Netherlands . |
| 2003712 | 3/1979 | United Kingdom . |
| 2103523 | 2/1983 | United Kingdom . |
| 2172032 | 9/1986 | United Kingdom . |
| 8204085 | 11/1982 | World Int. Prop. O. . |

*Primary Examiner*—Dennis L. Taylor

*Assistant Examiner*—J. Russell McBee

*Attorney, Agent, or Firm*—Price, Heneveld, Cooper, DeWitt & Litton

[57] ABSTRACT

A vibratory plow assembly 201 incorporates a vertical ground parting blade 202 with a front cutting edge 203 and a ripper tooth 208. The blade 202 is bifurcated rearwardly of the cutting edge 203, the blade 202 being formed by two spaced-apart side plates 214. The upper part of the plates 214 constitute a support frame which is pivotally connected by a pin 205 to a base plate 240. Attached rearwardly of the pivot pin 205 and preferably cantilevered beyond the plates 214 is a vibrator unit 232. The vibrator unit 232 when operational provides a vibratory frequency of between 5 Hz and 17 Hz to the ripper tooth 208 in both a vertical and arcuate path. The pivot pin 205 is preferably located above or forwardly of the cutting edge 203. The base plate 240 and supply frame, by virtue of the vibratory unit 232, experience relative movement in the manner of a pair of jaws the mouth of which extends rearwardly. Buffers 252 located between the base plate 240 and the support frame tend to bias the jaws into an open condition. A mounting means 400 enables the assembly 201 to be attached to a tractor vehicle so that in use, a trench is dug by the assembly 201 and cable, which passes from a forward position to a rearward position via cable guides 215 located between the plates 214, can be laid.

14 Claims, 13 Drawing Sheets

VIBRATORY PLOW ASSEMBLY

This invention relates to a vibratory plow assembly for mounting on a tractor vehicle.

The term tractor used in this specification means any vehicle such as a tractor, backhoe loader, truck or the like. Also, the term cable is taken to include electric and telecommunications cables, fibre optic cables and also any relatively small bore flexible conduit of the type used to protect electric cables or for use as a water pipe or the like.

When laying an underground electric cable a trench may be dug, normally about 300 mm wide, to receive the cable. Digging the trench is relatively time consuming. Furthermore, and as is usual, when digging is required adjacent a road or footpath, disruption to traffic is inevitable. The road surface or path is also adversely affected by digging the trench. When the trench is refilled it is difficult to repair the road surface correctly and usually either a hump or a hollow is left in the surface or path along the line of the trench.

To overcome this problem it is known to provide plow assemblies. Various different plow assemblies are shown in, for example, U.S. Pat. No. 4,087,982 (Golobay), U.S. Pat. No. 4,079,593 (Flippin), U.S. Pat. No. 4,040,261 (Schuck) and U.S. Pat. No. 3,935,712 (Erickson).

Generally, a blade is mounted on a tractor vehicle and drawn behind the tractor vehicle through the ground. A vibrator may be provided to vibrate the blade to facilitate drawing the blade through the ground. A cable is laid behind the blade, typically being delivered behind the blade by a tubular guide mounted at a rear of the blade. In use, the blade is mounted on a frame having ground engaging wheels and is drawn behind the tractor vehicle. A cable is laid in the ground behind the blade as it moves along. Unfortunately if a cable is being laid to one side of a road, the tractor vehicle may have to travel over uneven ground at the roadside resulting in uneven laying of the cable as the tractor, and hence the plow, moves over humps and hollows in the ground. This may lead to damage of the cable. It is known to provide side mounted plow assemblies which overcome this difficulty. Such assemblies are shown in, for example, U.S. Pat. No. 3,307,363 (Kinnan), U.S. Pat. No. 3,375,368 (Knapp) and U.S. Pat. No. 3,308,628 (Nichols) which overcome this difficulty. In many cases the cable guides are typically mounted behind the plow in an upright position so that the cable has to be turned through an acute angle as it is discharged from the guide to lay it horizontally behind the plow. This bending of the cable can damage the cable.

It is an object of this invention to provide a vibratory plow assembly having improved cable laying facilities which overcome these problems.

According to the invention there is provided a vibratory plow assembly which comprises a mounting support frame; a plow blade extending in use downwardly from the support frame, the plow blade having a leading edge; a vibratory means; means for mounting the vibratory means for operative association with the support frame; a base member; and means located forwardly of the vibratory means for pivotally connecting the base member to the support frame.

The present invention also provides a connecting means for use with an assembly according to the invention wherein the connecting means comprises a base integral with or attachable to the base member; the base member having two elements in substantially parallel spaced apart relationship and substantially perpendicular thereto; each of the elements having a respective slot for the reception of a complementary mounting pin of a tractor vehicle for securing the connecting means to the tractor vehicle, releasable locking means being provided to lock the pin in the slot.

The invention will be understood in from the following description of preferred embodiments thereof, given by way of example only, with reference to the accompanying drawings, in which.

Figure 1:
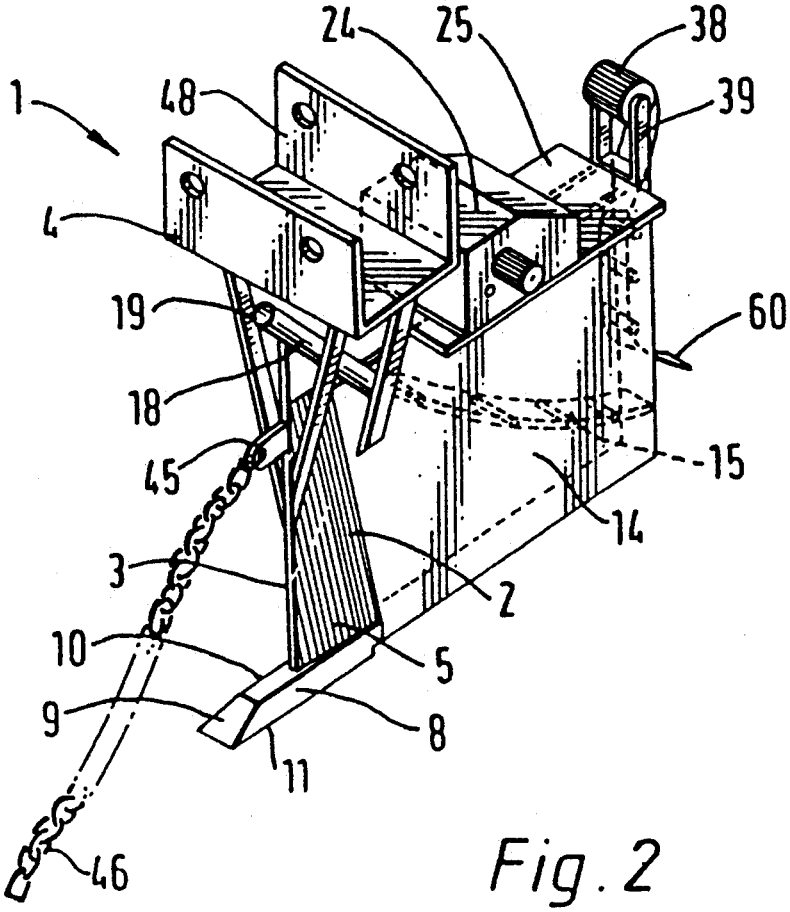
FIG. 1 is a perspective view of a vibratory plow assembly according to a first embodiment of the invention.
Figure 2:
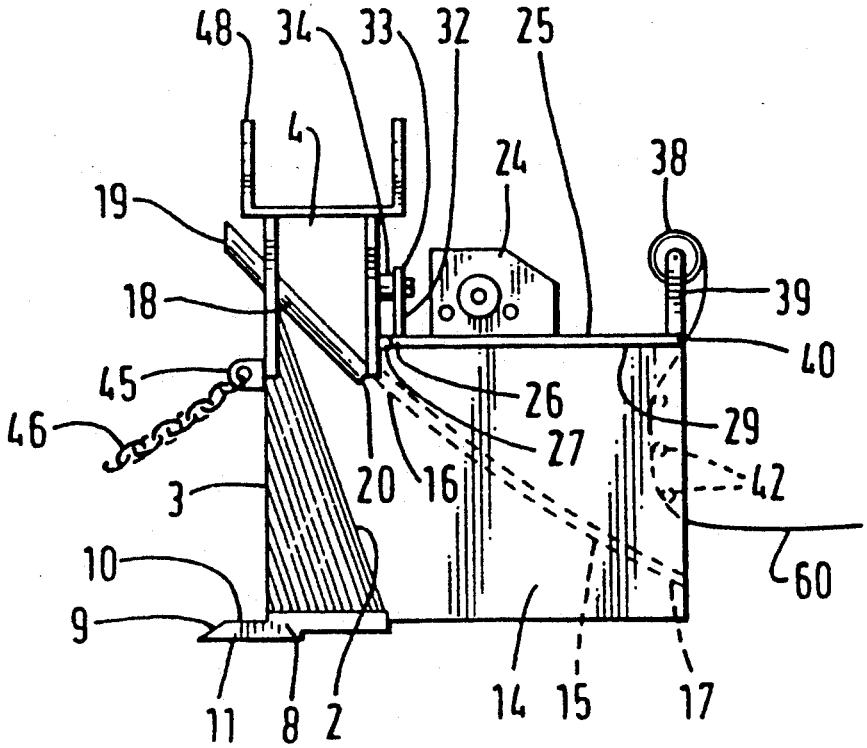
FIG. 2 is a side view of the assembly of FIG. 1 of the drawings.
Figure 3:
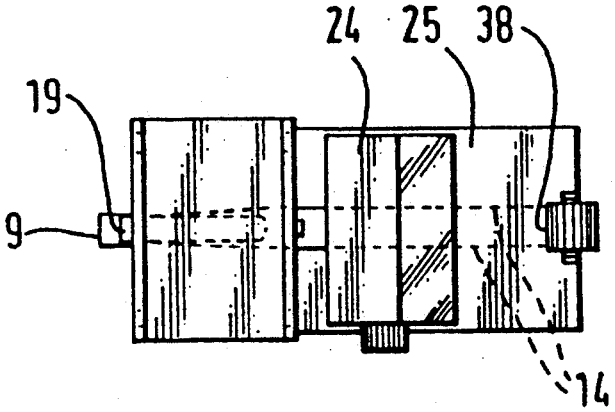
FIG. 3 is a plan view of the assembly of FIG. 1 of the drawings.
Figure 4:
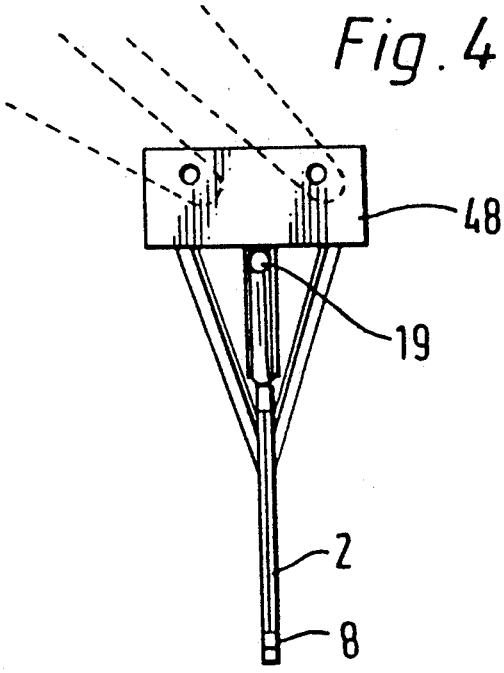
FIG. 4 is a front view of the assembly of FIG. 1 of the drawings.
Figure 5:
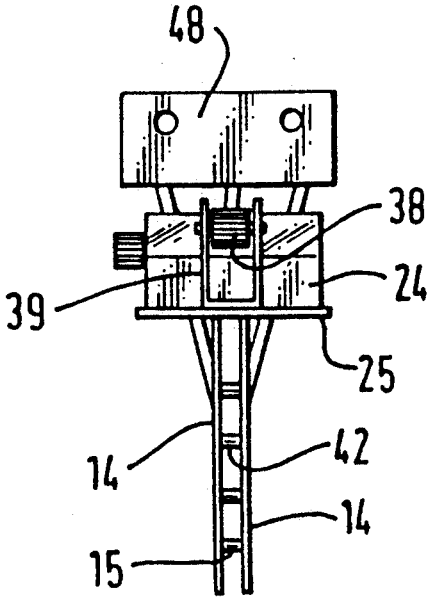
FIG. 5 is a rear view of the assembly of FIG. 1 of the drawings.

Referring to the drawings and initially to FIGS. 1 to 5 and FIG. 14 thereof, there is illustrated a vibratory plow assembly according to the invention and indicated generally by the reference numeral 1.

The assembly 1 comprises a vertical parting blade 2 with a front cutting edge 3 and having an upper end attached to a mounting support frame 4 and a lower end 5 on which is mounted a forwardly projecting ripper tooth 8. A front face 9 of the ripper tooth 8 slopes downwardly and forwardly from a top 10 to a bottom 11 of the ripper tooth 8. In this case the parting blade 2 is bifurcated rearwardly of the front cutting edge 3, the parting blade 2 having two spaced-apart rearwardly extending substantially rectangular side plates 14. A cable guide is formed by an arcuate member 15 attached to the sides plates 14 and extending between the side plates 14 downwardly and rearwardly from a front upper portion 16 to a lower rear portion 17 of each side plate 14. Attached to the mounting support frame 4 is a cable guide tube 18 having a forwardly facing inlet 19 and an outlet 20 located between the side plates 14 at the front upper portion 16.

A hydraulically operated vibrator 24 is mounted on a substantially horizontally arranged vibrator support plate 25 above the side plates 14 of the parting blade 2. An inner end 26 of the vibrator support plate 25 is pivotally connected by a pivot pin 27 to the mounting support frame 4 allowing vertical movement of the vibrator support plate 25 which rests on top edges 29 of the side plates 14. The pivot pin 27 is mounted so as to be transverse relative to the plane of the blade 2 and located forwardly of the vibrator 24. An upstanding bracket 32 at the inner end 26 of the vibrator support blade 25 has an upper end 33 connected by a rubber mounting member 34 to the mounting support frame 4.

A warning tape reel 38 is mounted by a reel support bracket 39 at a rear end 40 of the vibrator support plate 25. Associated warning tape guide pins 42 extend between the two side plates 14. At a front end of the mounting support frame 4 is an eye 45 having a towing chain 46 attached. The mounting support frame 4 also has a mounting bracket 48 for attachment to a tractor in conventional fashion.

Figure 13:
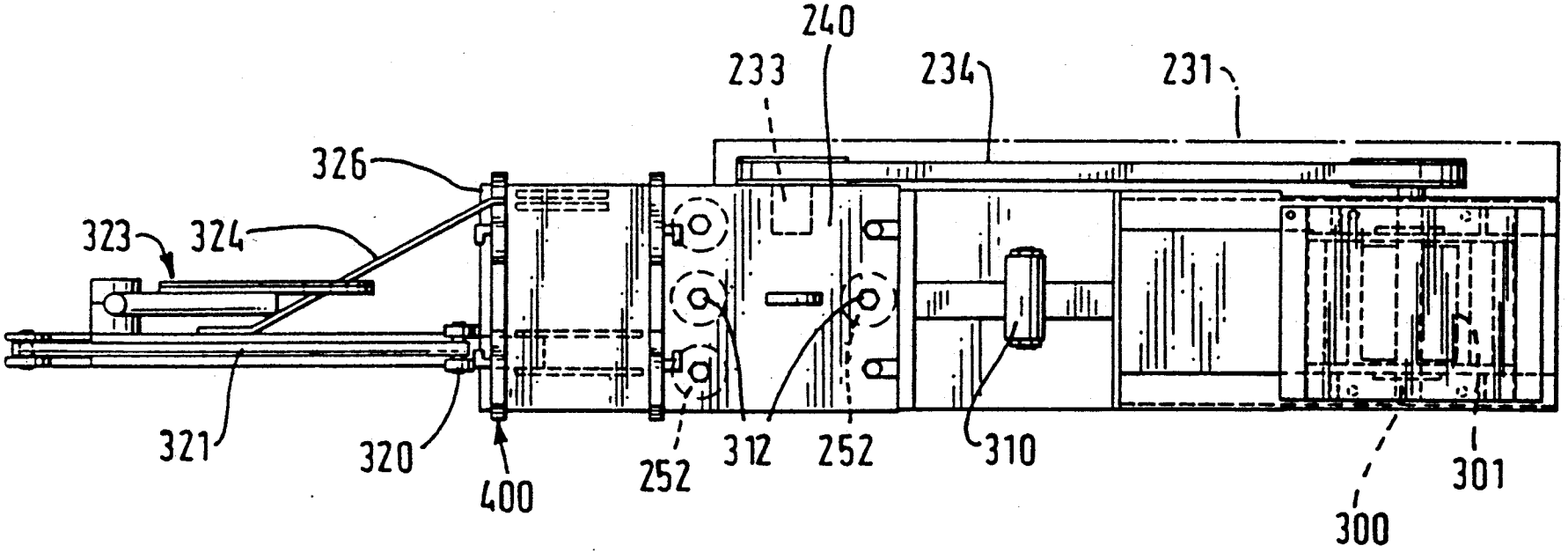
FIG. 13 is a plan view of the assembly of FIG. 11 of the drawings.
Figure 14:
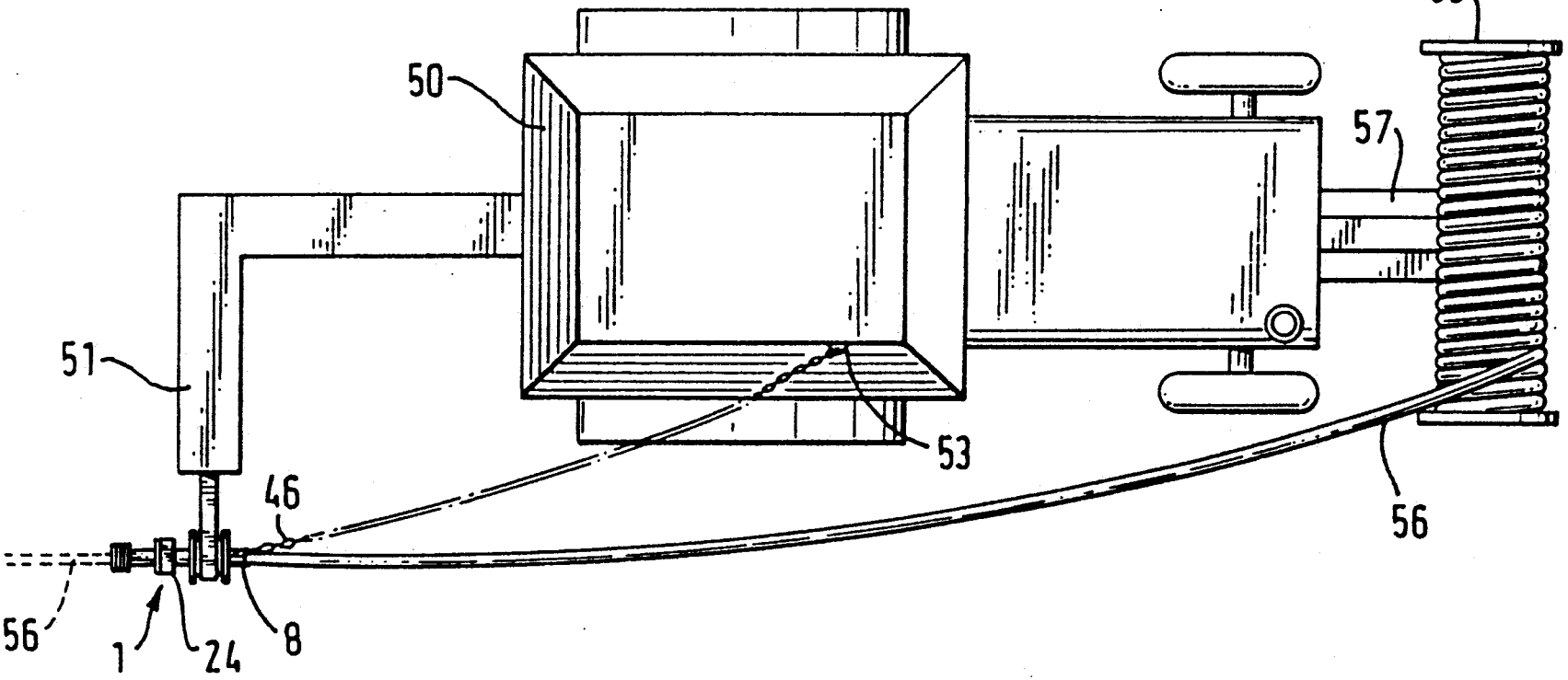
FIG. 14 is a diagrammatic plan view of a vibratory plow assembly according to the invention shown in use mounted on a tractor.
Figure 15:
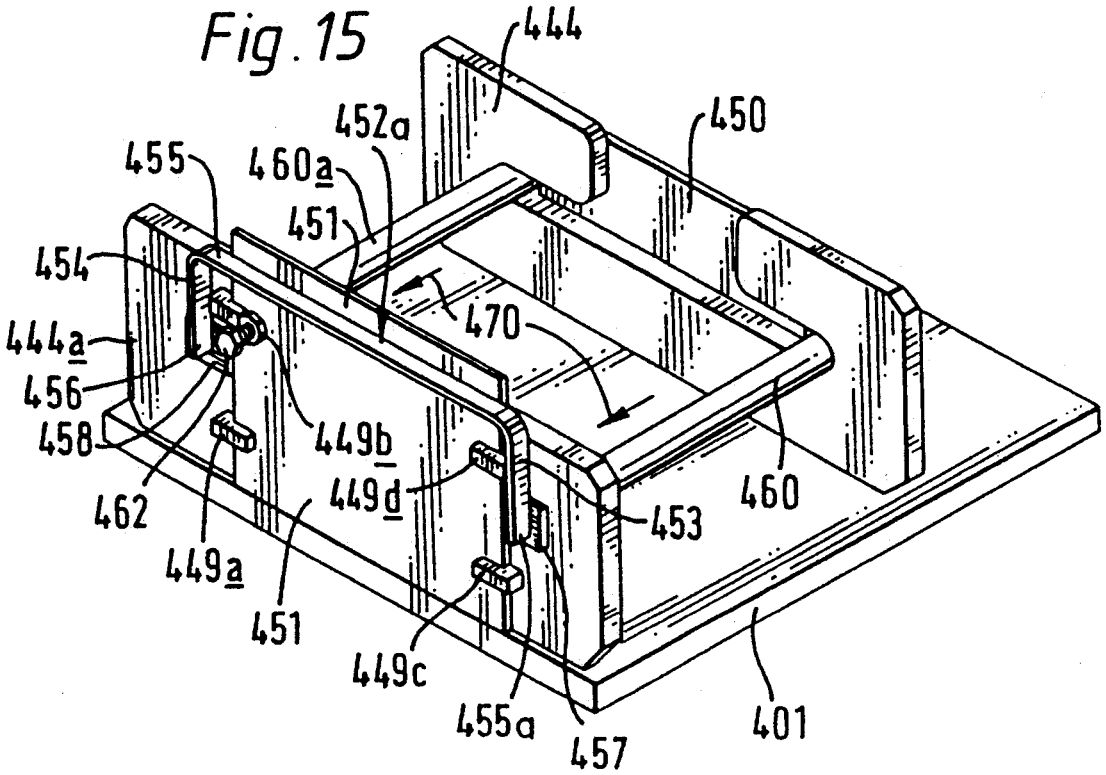
FIG. 15 is a first perspective view of a connecting means for use with the assembly of FIGS. 1–14 of the drawings.
Figure 16:
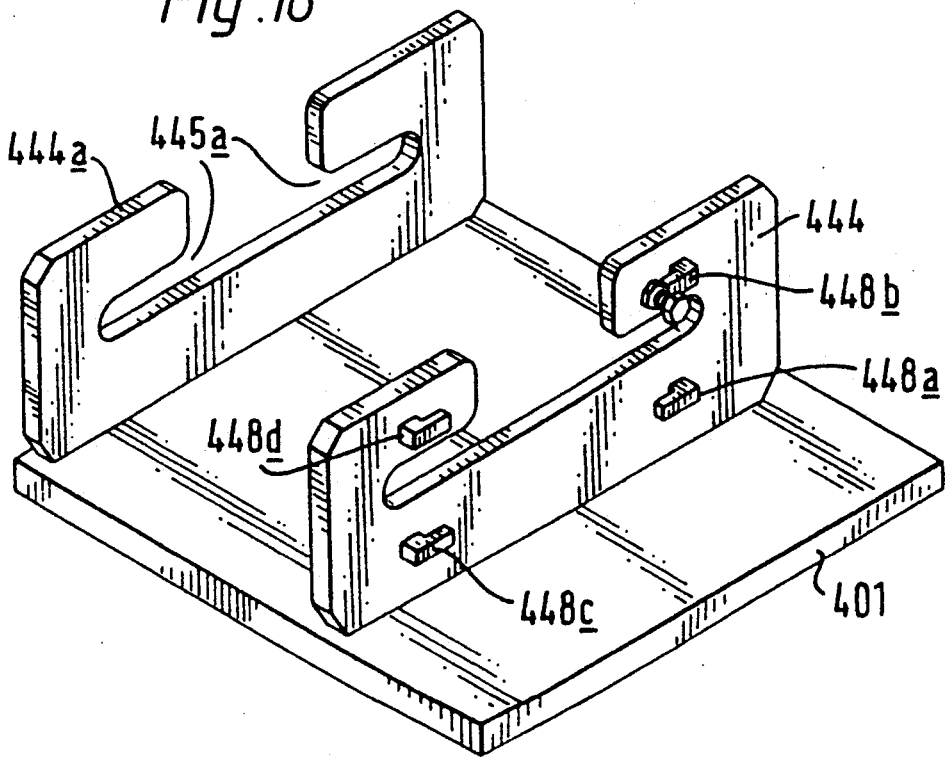
FIG. 16 is a second perspective view of part of the connecting means of FIG. 15 of the drawings.
Figure 17:
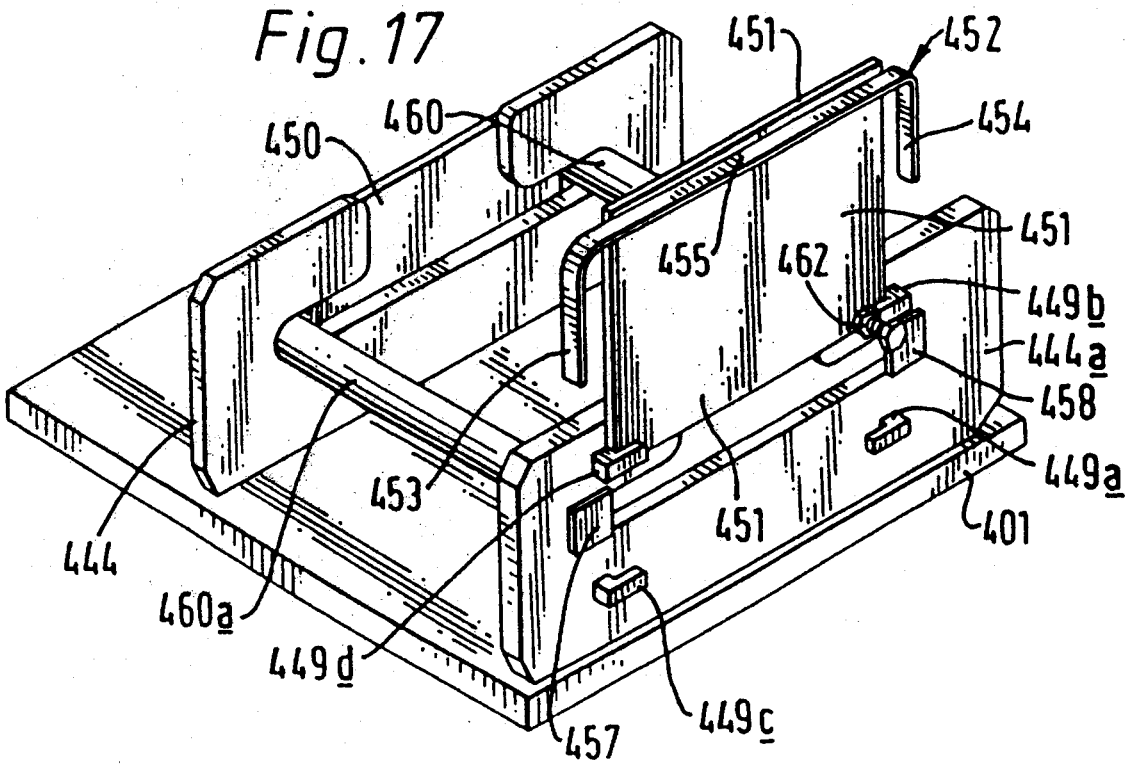
FIG. 17 is another first perspective view of the connecting means of FIG. 15 of the drawings.
Figure 18:
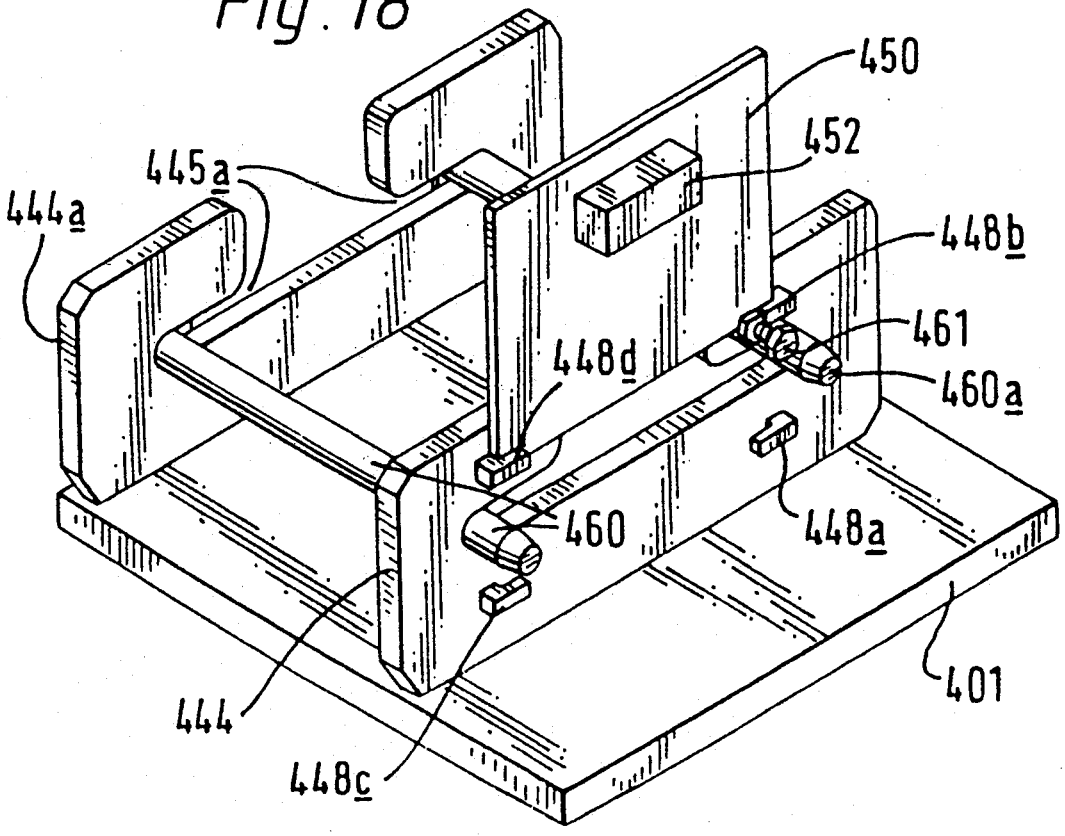
FIG. 18 is another second perspective view of part of the connecting means of FIG. 15 of the drawings.
Figure 19:
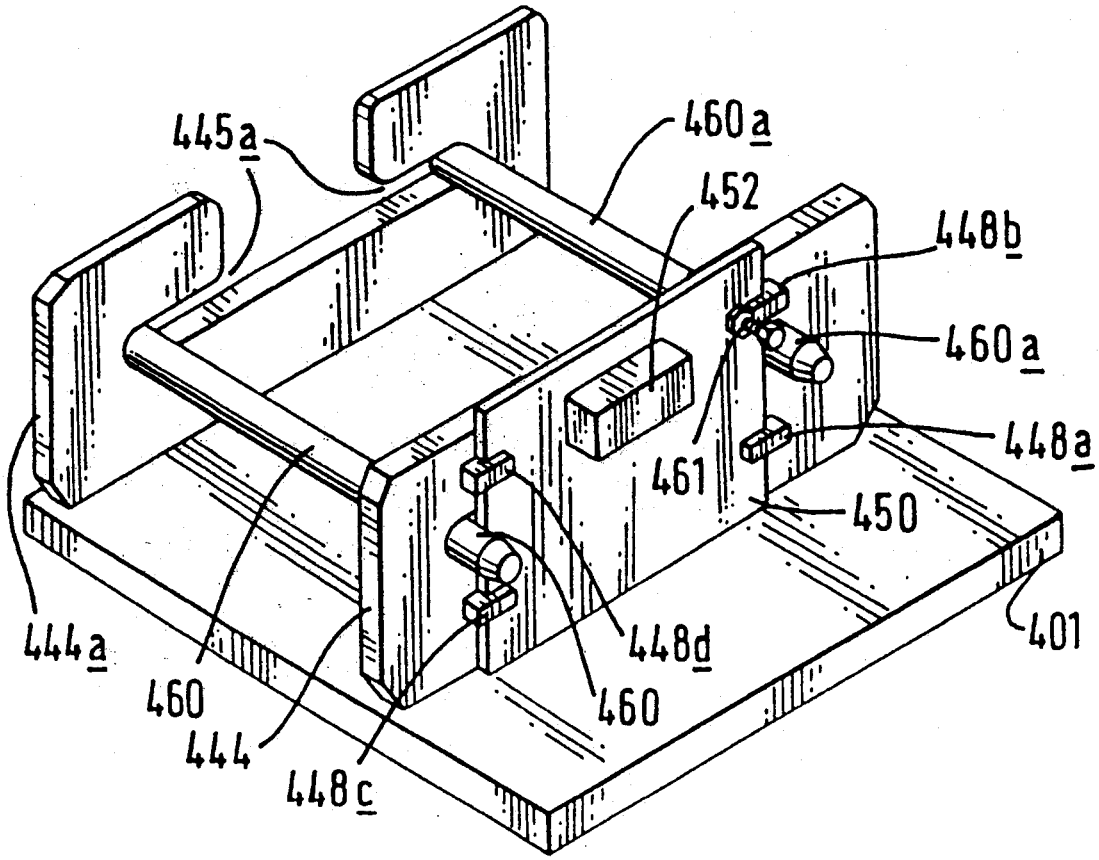
FIG. 19 is another second perspective view of part of the connecting means of FIG. 15 of the drawings.
Figure 21:
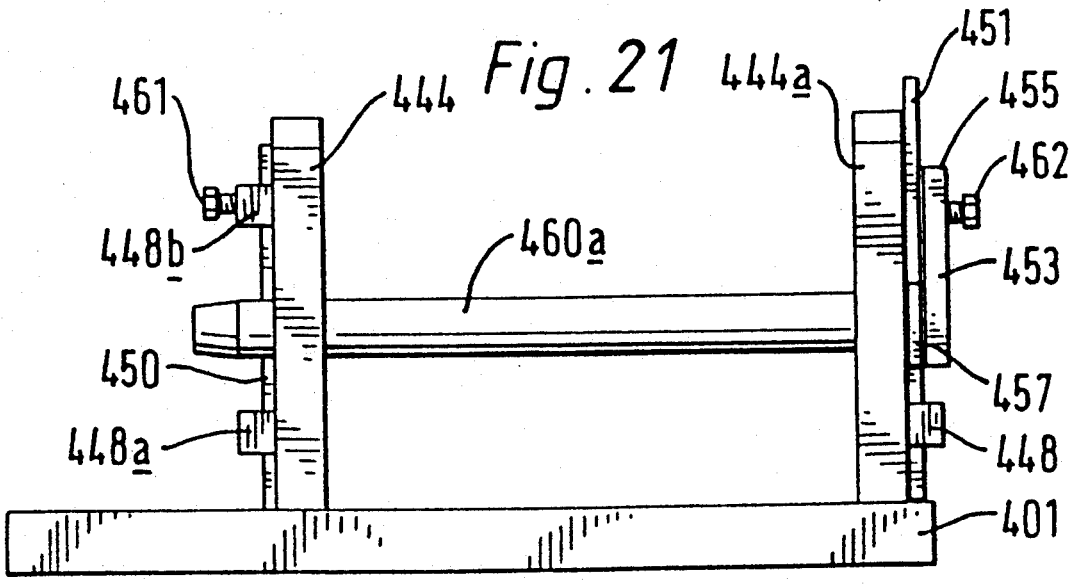
FIG. 21 is a side elevation of the connecting means of FIG. 15 of the drawings.

FIG. 14 shows the assembly 1 mounted on a tractor 50, which in this case is a backhoe loader of conventional construction with a rear hydraulic tool support arm 51, the assembly 1 being mounted at an outer end of the rear hydraulic arm 51 which is extended laterally of the tractor 50. The towing chain 46 is secured to a mounting bracket 53 at a forward end of the tractor 50 to pull the parting blade 2 of the assembly 1 through the ground. It will be noted that the assembly 1 is not rigidly attached to the rear hydraulic arm 51; it is allowed some play on the rear hydraulic arm 51. This loose support of the assembly 1 is important for an effective cutting action by the parting blade 2, insuring that, in use, vibrations created by the vibrator 24 are transmitted to the front cutting edge 3 and ripper tooth 8 of the parting blade 2 rather than to the tractor 50. Furthermore having regard to the relative position of the pivot pin 27 being located forwardly of the vibrator 24, the front face 9 of the ripper tooth 8 performs an arcuate movement which is described more fully later in the Specification with reference to FIGS. 11-14 of the drawings. A reel 55 of a cable 56 is supported on front arms 57 of the tractor 50.

In use, the assembly 1 is mounted as shown in FIG. 14 on the tractor 50. As the tractor 50 is driven in a forward direction, the parting blade 2 is drawn through the ground at one side of the tractor 50 and the cable 56 delivered into the hole created by the parting blade 2 and ripper tooth 8. The elevation of the rear hydraulic arm 51 on the tractor 50 can be adjusted up or down to vary the depth at which the cable 56 is laid. As the parting blade 2 moves through the ground the ripper tooth 8 and front cutting edge 3 of the parting blade 2 part the ground and the cable 56 is delivered from the reel 55 through the guide tube 18 and between the side plates 14 of the parting blade 2 to the bottom of the hole created by the assembly 1. Vibrations created by the vibrator 24 are transferred through the side plates 14 to the ripper tooth 8 and front cutting edge 3 to assist travel of the parting blade 2 and ripper tooth 8 through the ground. It will be noted also that a warning tape 60 from the reel 38 is delivered over the tape guide pins 42 into the hole approximately 300 mm above the cable 56. As the assembly 1 only slices a trench approximately 50 mm to 75 mm wide in the ground the trench tends to reseal itself after the assembly 1 has passed and generally no infill or resurfacing is required.

An important feature of the construction shown in FIGS. 1-5 and 14 of the drawings is that the reel of cable 55 is located forwardly of the assembly 1 and thus, with the aid of the cable guide 15 and cable tube 18, the cable 56 travels from the cable reel 55 to the trench without the need for the cable 56 to traverse through acute or relatively acute angles. This is particularly important when the cable 56 is a fibre optic cable.

Figure 6:
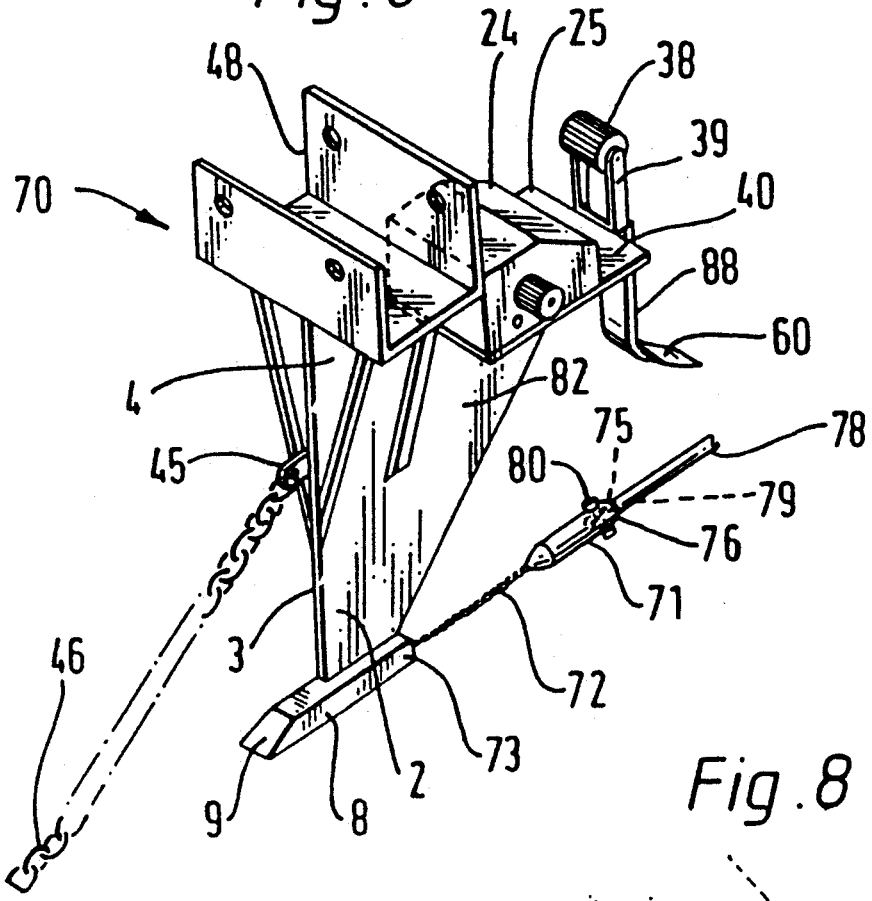
FIG. 6 is a perspective view of a vibratory plow assembly according to a second embodiment of the invention.
Figure 7:
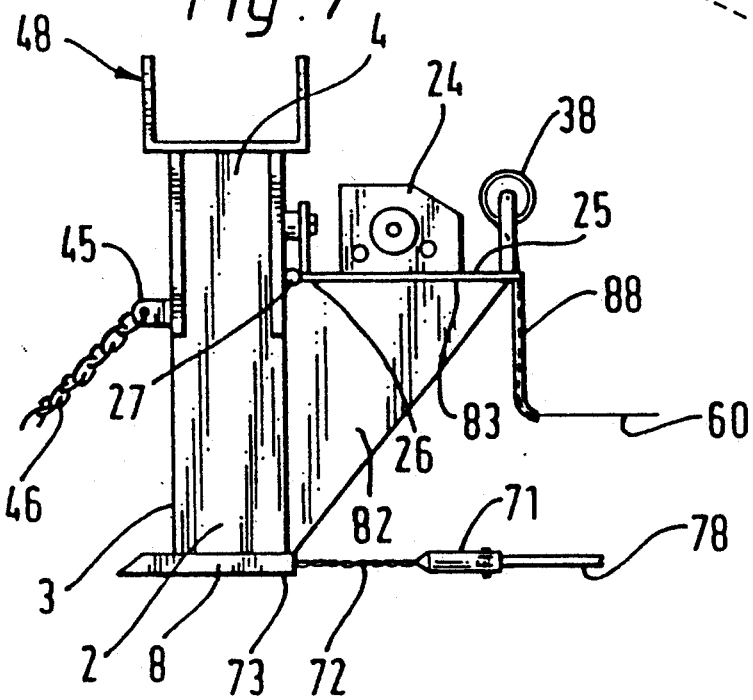
FIG. 7 is a side view of the assembly of FIG. 6 of the drawings.
Figure 8:
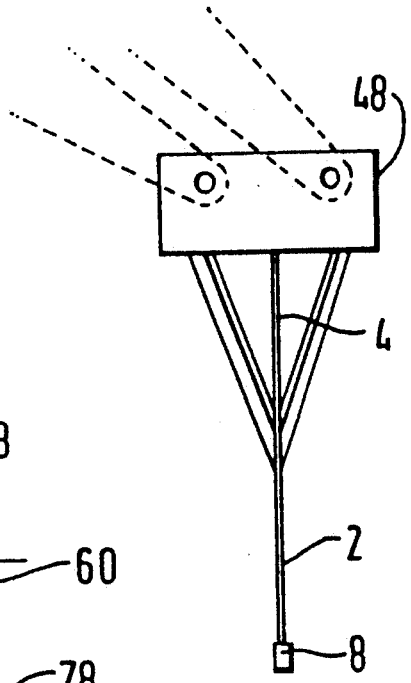
FIG. 8 is a front view of the assembly of FIG. 6 of the drawings.

Referring now to FIGS. 6 to 8 there is illustrated another plow assembly 70 according to the invention. This is largely similar to the assembly described previously with reference to FIGS. 1 to 5 of the drawings and the like parts are assigned the same reference numerals. In this case a cable holder 71 is attached by a chain 72 at a rear end 73 of the ripper tooth 8. A socket 75 is provided in a rear end 76 of the holder 71 to receive a cable, in this case a plastics pipe 78 having an outer end 79, secured within the socket 75 by a bolt 80. A rear portion of the parting blade 2 comprises a triangular plate 82 having an upper edge 83 on which the vibrator support plate 25 rests. A warning tape guide tube 88 depends from the rear end 40 of the vibrator support plate 25.

Use of the assembly 70 is similar to use of the assembly described previously with reference to FIGS. 1 to 5 of the drawings. In this case, however, the cable 78 is not mounted on the tractor 50 but rather is pulled behind the ripper tooth 8 through the hole created by the ripper tooth 8. Warning tape 60 is dispensed through the guide tube 88 above the cable 78. As the cable 78 is not delivered through the parting blade 2 in the manner described in the previous embodiment, a much narrower parting blade can be used which is easier to draw through the ground and the hole formed by the assembly 70 is more easily resealed.

Figure 9:
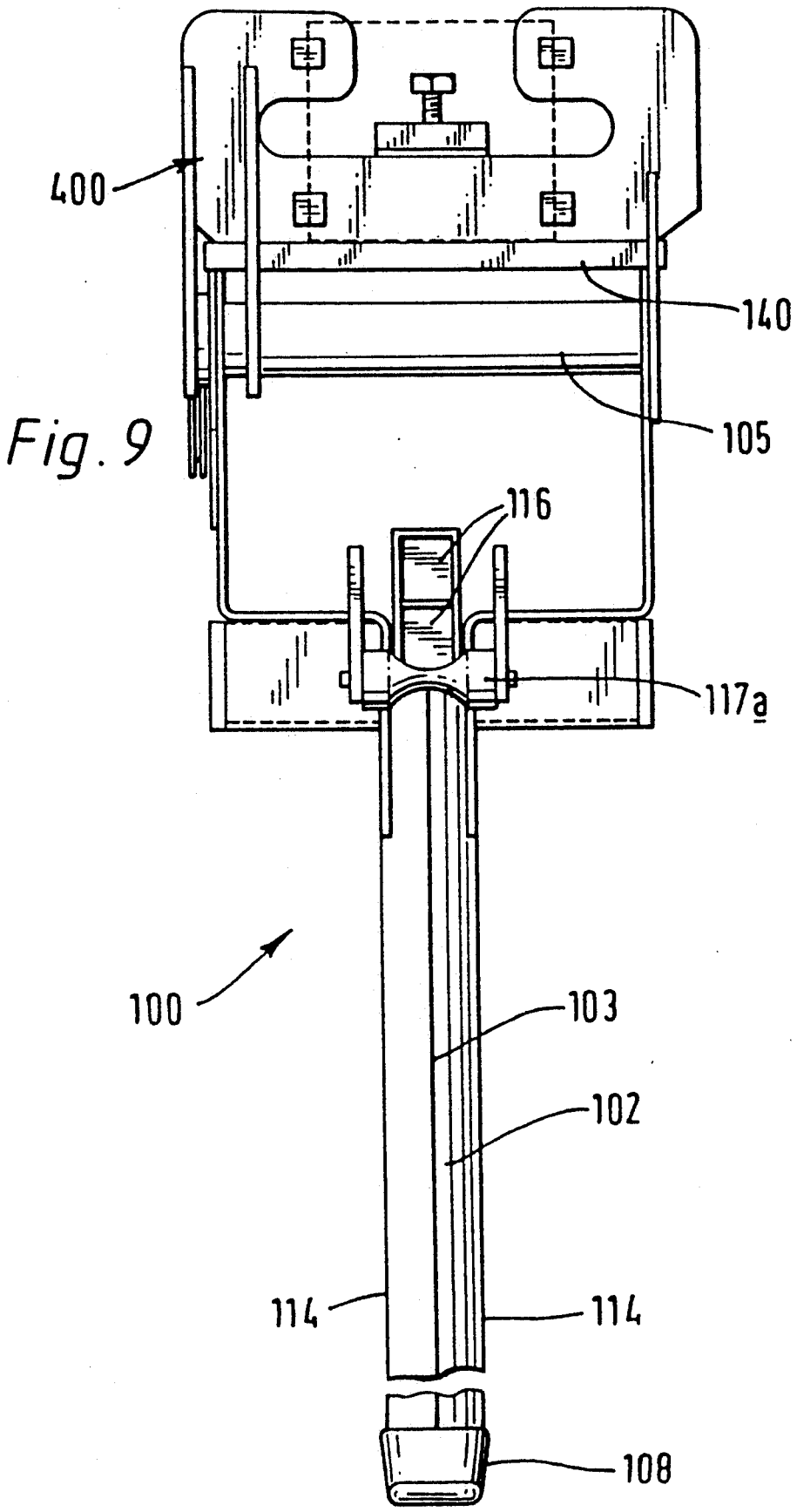
FIG. 9 is a front elevational view of a vibratory plow assembly according to a third embodiment of the invention.
Figure 10:
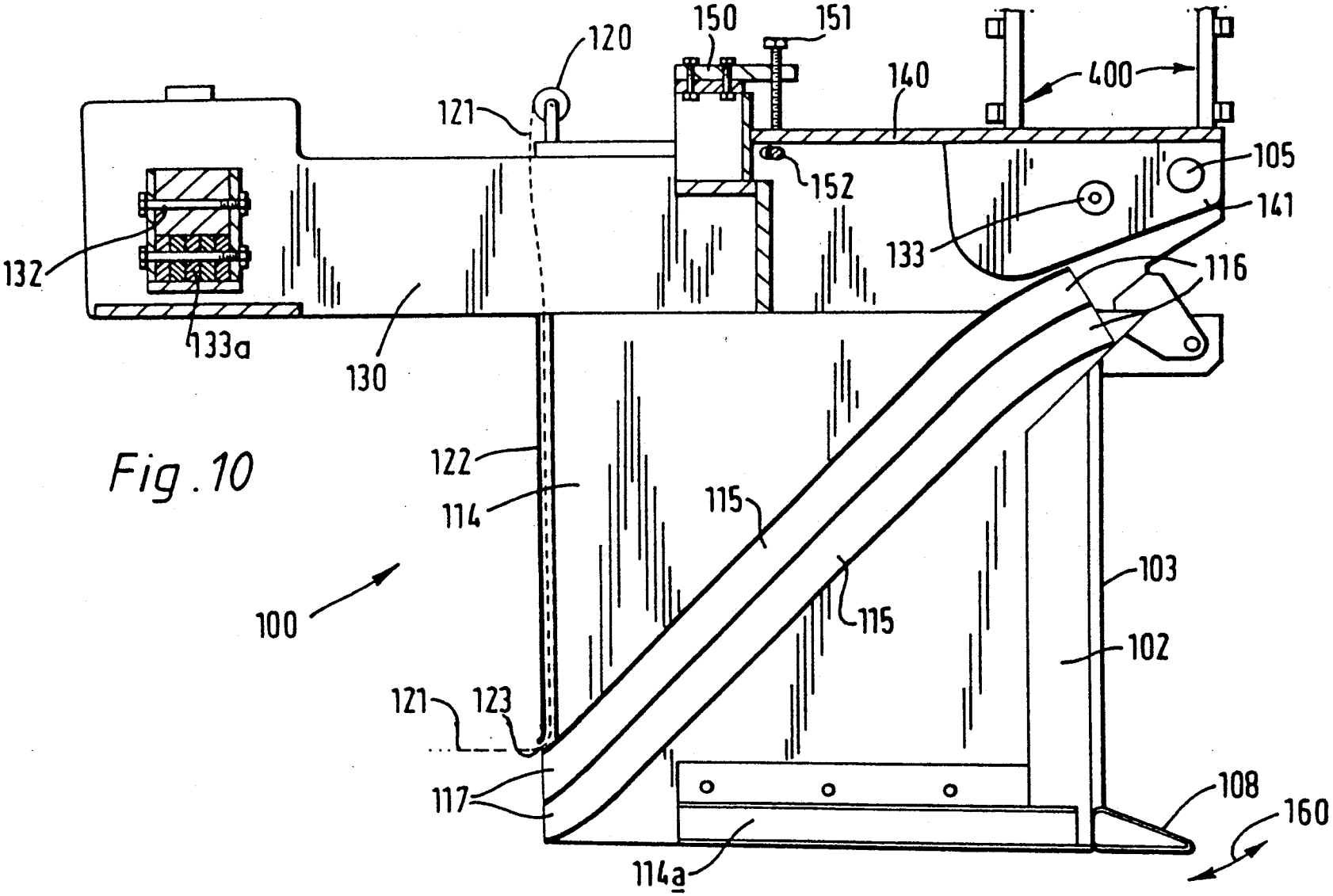
FIG. 10 is a side sectional view of the assembly of FIG. 9 of the drawings.

Referring now to FIGS. 9 and 10 of the drawings there is illustrated another plow assembly 100 according to the invention. The assembly 100 comprises a vertical parting blade 102 with a front cutting edge 103. An upper end of the blade 102, which constitutes a mounting support frame, is pivotally attached to a base plate 140 by a pivot pin 105. The pivot pin 105 is mounted so as to be positioned transversely relative to the plane of the blade 102 and located forwardly of the cutting edge 103. A forwardly projecting ripper tooth 108 is provided at a lower end of the blade 102. The parting blade 102 is bifurcated rearwardly of the front cutting edge 103, the blade 102 having two spaced-apart rearwardly extending substantially rectangular side plates 114. Each of the plates 114 is provided with a reinforcement plate 114*a* at a lower end thereof so as to reduce the rate of wear of the plates 114. A cable guide is formed by a pair of tubes 115 mounted between the side plates 114. Each tube 115 has an inlet 116 at a front upper part of the blade 102 and an outlet 117 at a rear lower part of the blade 102. A cable feed roller 117a is positioned in front of the tube inlets 116.

A warning tape reel 120 is mounted at a rear end of the blade 102 on top of the blade 102. Tape 121 is fed from the reel 120 through a tape guide pipe 122 vertically mounted at a rear edge of the blade 102. The pipe 122 has an outlet 123 above the outlets 117 from the tubes 115.

At an upper end of the blade 102 a cantilevered vibrator housing 130 extends rearwardly of the blade 102. A shaft 132 is rotatably mounted near the free rear end of the housing 130. An associated hydraulic drive motor 133 is mounted adjacent a front end of the blade 102 and drive is transmitted from the motor 133 to the shaft 132 by means of a belt drive (not shown) extending through the housing 130. The shaft 132 has a relatively large mass 133a eccentrically mounted thereon.

The base plate 140 is provided with a pair of downwardly depending flanges 141 on each side thereof. Each flange 141 has a through hole for reception of the pivot pin 105 to pivotally attach the base 140 relative to the blade 102. Upstanding on or attached to the base plate 140 is a mounting means 400 for attachment to a tractor. The mounting means 400 is shown in greater detail in FIGS. 15-21 of the drawings and is described more fully later in the Specification.

At a rear end of the base plate 140 a bracket 150 on the blade 102 overhangs the base plate 140. A threaded bolt 151 mounted on the bracket 150 is operable to adjust the arc of swing between the base plate 140 and the blade 102. Rubber buffers 152 are mounted on the side plates 114 beneath the base plate 140. The rubber buffers 152 act as a biasing means to urge the side plates 114 and the base plate 140 apart.

In use, the assembly 100 operates in a manner similar to the assembly described with respect to FIGS. 1-6 of the drawings. Cable is delivered to and guided by the cable feed roller 117a into the respective tubes 115 from which they emerge at outlets 117 having been guided without severe or even moderate bending, between the side plates 114 to be positioned directly in the trench made by the blade 102 and ripper tooth 108.

In addition, having regard to the position of the pivot 105, which is located forwardly of the blade 102 and substantially above the ripper tooth 108 relative to the rearwardly and cantileverdly located vibrator 132, the blade 102 not only oscillates in an upward/downward motion but also moves in an arcuate manner about the pivot 105 shown by the arrow 160. The arcuate movement and the thrust imparted by the blade 102 and particularly by the ripper tooth 108 is considerably enhanced by the relative positions of the pivot point 105 and the rearward and, in particular, the cantilevered location of the shaft 132 and associated mass 133a. When the shaft 132 is in operation, there is created relative movement between the base 140 and the blade 102 about the pivot point 105. This action can be more fully appreciated by reference to the description in FIGS. 11-14 of the drawings.

Referring to FIGS. 11-14 of the drawings, there is illustrated a vibratory plow assembly according to the invention indicated generally by the reference numeral 201. The assembly 201 incorporates a vertical ground parting blade 202 with a front cutting edge 203. A forwardly projecting ripper tooth 208 is provided at a lower end of the blade 202.

The parting blade 202 is bifurcated rearwardly of the front cutting edge 203 in a manner substantially similar to that shown in FIGS. 1-5 of the drawings, the blade 202 formed by two spaced-apart rearwardly extending substantially rectangular side plates 214. The upper part of the plates 214, which constitute a mounting support frame, extend forwardly so that said upper part is pivotally attached to a base plate 240 by a pivot pin 205. The pin 205 is mounted so as to be positioned transversely relative to the plane of the blade 202 and is located forwardly of the cutting edge 203 and substantially above the ripper tooth 208. If desired, the pivot pin 205 may be located directly above the cutting edge 203. The base plate 240 has a pair of downwardly depending flanges 241 provided at each side of the base plate 240. Each flange 241 has a collar 242 for reception of the pivot pin 205 to pivotally attach the base plate 240 to the plates 214. The base plate 240 has a connecting means 400 for mounting the assembly 201 to a tractor, backhoe loader or the like. The connecting means 400 is described in more detail hereinafter with reference to FIGS. 15-21 of the drawings.

A cable guide is formed by tubes 215 mounted between the side plates 214. Each tube 215 has an inlet 216 at a front upper part of the blade 202 and an outlet 217 at a rear lower part of the blade 202.

A warning tape reel 220 is mounted at a rear end of the blade 202 on top of the blade 202. Tape can be fed from the reel 220 through a tape guide pipe to an outlet above the outlets 217 from the tubes 215.

At an upper end of the plates 214 a cantilevered vibrator support 230 extends rearwardly of the blade 202 and is enclosed within a housing 231. A vibrator unit 232 is mounted at a free rear end of the support 230. The vibrator unit 232 comprises a shaft 300 having a substantially large mass 301 eccentrically mounted thereon. An associated hydraulic drive motor 233 (FIG. 13) is mounted adjacent a front end of the support 230 and drive is transmitted from the motor 233 to the shaft 300 by means of a belt drive 234 extending through the housing 231. The mass 301 can rotate about an axis which extends transversely relative to the plane of the blade 201.

At a rear end of the base plate 240 rubber buffers 252 are mounted on an underside of the base plate 240 and are engageable with hands 253 on top of the plates 214. Thus, relative movement between the base plate 240 and the plates 214 is provided about the pivot pin 205 in the manner of a pair of jaws with the mouth of the jaws opening rearwardly. The buffers 252 act as a biasing means for urging the base plate 240 and the plates 214 apart. The buffers 252 may be replaced by any other suitable biasing means such as coil springs or leaf springs.

Attached to the base plate 240 is an eye member 310 for enabling the assembly 1 to be lifted from a trailer or from the ground. It will be appreciated that having regard to the pivotal relationship between the base plate 240 and the plates 214 about the pivot 205, the lifting of the base plate 240 would result in the plates 214 and all associated components to swing clockwise as viewed in FIG. 11 of the drawings. In order to prevent such an occurrence, the plates 214 have a plurality of bolts 311 attached thereto having a threaded portion at the free ends thereof. The bolts 311 extend through suitable openings (not shown) in the base plate 240 and, for convenience, can pass through the respective buffers 252 each of which has an aperture in register with the openings of the base plate 240. A suitable nut 312 is mounted on each bolt 311 above the base plate 240. Because the buffers 252 tend to act as a biasing means thereby opening the gap between the base plate 240 and the plates 214, the nuts 312 should be tightened only to the extent of not biasing the base plate 240 and the plates 214 towards each other. However, if the base plate 240 is lifted, the bolts 311 together with the associated bolts nuts will enable the plates 214 and associated components to be lifted without the swinging action referred to above taking place.

Pivotally attached to the plates 214 at 320 is a beam 321 from which depends an arm 322. The arm 322 has a conventional coulter means 323 rotatably attached thereto. The beam 321 is supported by a member 24 at 325, the other end of member 324 being pivotally attached to the base plate 240 at 326.

Also attached to the plates 214 is a pair of towing eyes 330 to which may be attached a respective chain (see FIG. 14).

In use, the base plate 240 is attached to a suitable vehicle such as a tractor 50 (FIG. 14) having a hydraulic power take-off. The motor 233 is connected to the power take-off of the tractor 50 and the assembly 201 placed in a position for commencement of work. The motor 233 is actuated which via the belt drive 234 causes the shaft 300 to rotate and thus lifts the mass 301 from a lowered or 6 o'clock position to an elevated or 12 o'clock position. Rotation of the shaft 300 should be of the order of between 300 and 800 revolutions per minute thereby providing a vibrating frequency of between 5 Hz and 14 Hz. As the mass 301 drops rapidly from the 12 o'clock position back to the 6 o'clock position and having regard to the stationary condition (in the vertical sense) of the base plate 240, the plates 214 receive a kick such that the ripper tooth 208 moves in an arcuate manner forwardly and upwardly. In other words, there is pivotal movement between the base plate 240 and the plates 214 about the pivot 205. When the ripper tooth 208 is at the upper point of the arc, the base plate 240 and the plates 214 (acting as jaws) are open to their maximum extent. As the mass 301 is being lifted from the 6 o'clock condition to the 12 o'clock condition, the jaws close in reaction to the opening movement of the jaws thereby pressing on the buffers 252 and squashing them so as to reduce their thickness. Having regard to the resilient nature of the material of the buffers 252, the buffers 252 now tend to bias the jaws apart, which coupled with the now falling mass 301 provides a further kick for the ripper tooth 208. It is important that the frequency of rotation of the shaft 300 should be less than 1000 rpm (vibratory frequency of 17 Hz) as otherwise the effect of the vibrator unit 232 and particularly the combined effects of the buffers 252 and the vibrator unit 232 may not be achieved.

As the ripper tooth 208 is moving upwardly and forwardly, there will be a slight relaxing of tension between the chain 46 connecting the tractor 50 with the assembly 201. The retensioning of the chain 46 provides a further kick or forward motion for the ripper tooth 208 which further aides in the excavation of the trench. This combined action has been found to be particularly advantageous in that in the absence of the vibratory unit 232, a tractor having a towing power of about 300 hp (225 kw) was found to be required when compared with an 80–100 hp (60–75 kw) requirement when the vibratory unit 232 is in operation. It will be appreciated, therefore, that there are considerably savings in capital outlay and energy costs when the assembly according to the invention is used compared with conventional plow assemblies.

Cable is guided into the inlet 216 at the front upper part of the blade 202, guided through the tubes 215 so as to exit at the outlets 217. With the cable drum located forwardly of the assembly 201, the cable being laid does not traverse any acute or even moderately acute angles when being laid. It will be appreciated that one or more cables may be laid in the same trench simultaneously.

When the assembly 201 is attached to the arm of a backhoe loader, the arm enables the assembly 201 to be placed in use to one side of the vehicle.

The description of the operation of the vibratory unit 232 is also applicable to the embodiments shown in FIGS. 1–10 of the drawings. However, the effects of the vibratory unit are particularly enhanced when the unit is located in a cantilevered manner as shown in FIGS. 9–13 of the drawings and or the pivot pin 205 is located above or forwardly of the cutting edge 203.

Figure 11:
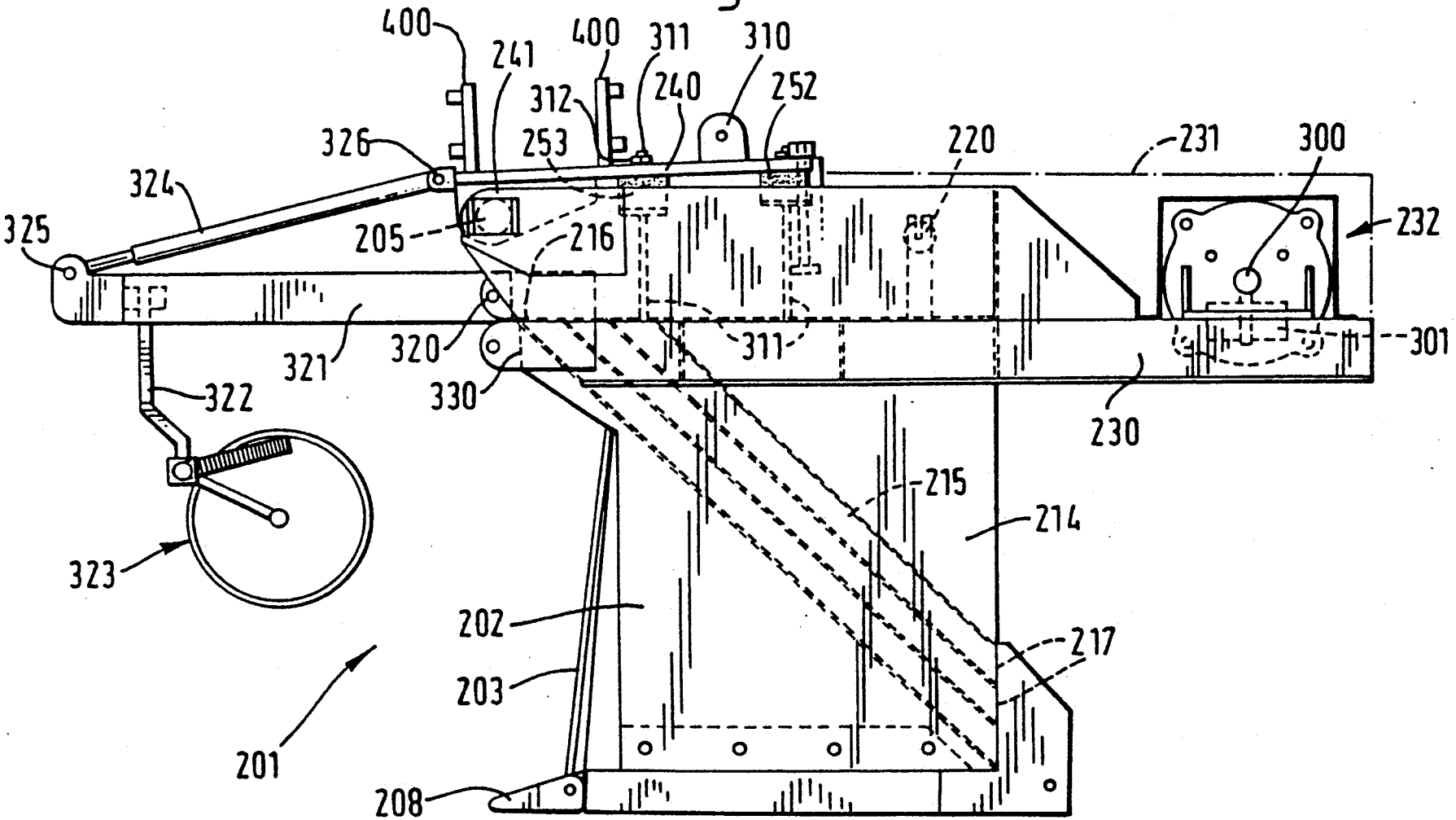
FIG. 11 is a first side elevation view of a vibratory plow assembly according to the a fourth embodiment of the invention.
Figure 12:
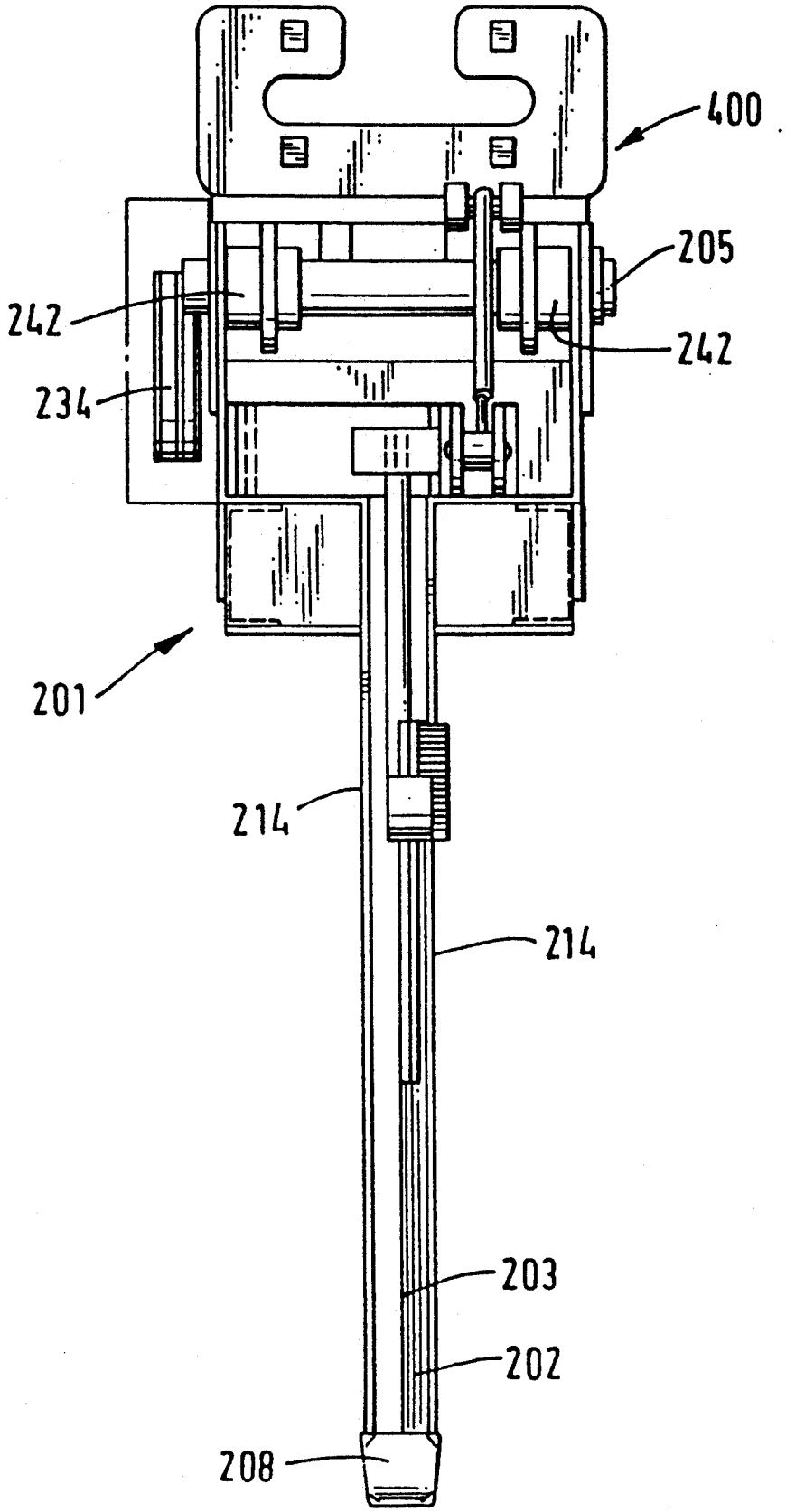
FIG. 12 is a front elevation view of the assembly of FIG. 11 of the drawings.

It should be noted that the plow assembly shown in FIG. 14 of the drawings as reference numeral 1 may be substituted by the assembly 70 (FIGS. 6–8 of the drawings), 100 (FIGS. 9–10 of the drawings) or 201 (FIGS. 11–13 of the drawings).

It will be appreciated that references to "tractor" in the Specification and claims means any vehicle such as a tractor per se, a backhoe loader, a truck or the like. References to "cable" in the Specification and claims means any electric or telecommunications cable, a fibre optic cable, and also any relatively small bore flexible conduit of the type used to protect electric cables or for use as a water pipe or the like.

Referring now to FIGS. 15–21 of the drawings, there is shown a connecting means 400 for use with the plow assembly according to the invention.

The connecting means 400 comprises a base 401 which may be mounted on or integral with for example the base plate 240 of the assembly 201 of FIGS. 11–13 of the drawings. Upstanding on the base 401 is a pair of transverse mounting brackets 444 and **444*a* in substantially parallel spaced-apart relationship relative to each other. Each bracket has a respective inverted T-shaped slot 445 and 445*a* for the reception of respective pins 460, 460*a* of, for example, a backhoe loader. Each slot 445, 445*a* has a narrow mouth which leads into laterally disposed recesses for reception of the pins 460, 460*a***.

Associated with each slot 445, **445*a* is a plurality of L-shaped guides. Thus, for example, the bracket 444 has guides 448*a*, 448*b*, 448*c* and 448*d* mounted on an externally orientated face of the bracket 444. Similarly, the bracket 444*a* has guides 449*a*–449*d* associated therewith. Slidably engageable with the guides 448*a*–448*d* is a locking plate 450. Slidably engageable with the guides 449*a*–449*d* is a locking plate 451**.

The locking plate 450 includes a handle 452 for enabling the plate 450 to be raised/lowered in the guides **448*a*–448*d*. When the plate 450 is in the lowered condition (FIGS. 15 and 19) and having regard to the location of the guides 448*a*–448*d* relative to the slot 445, an aperture is provided for each pin 460, 460*a*. The guide 448*b* may be provided with a bolt and locking nut arrangement 461 in threaded engagement therewith so that rotation of the bolt in a clockwise direction (as viewed in FIG. 19) results in the tip of the bolt 461 engaging with the plate 450 and preventing the plate 450 from accidentally being removed from between the guides 448*a*–448*d*. When in the lowered position, the base of the plate 450 is in contact with the base 401. The plate 450 may be reinforced on opposing sides which contact the pins 460, 460***a* so as to reduce the degree of wear and tear thereof.

The locking plate 451 is substantially similar to the plate 450 and engages with the guides 449*a*–449*d* in a similar fashion. The guide 449*b* is also provided with a bolt and locking nut arrangement 462 which functions is a manner similar to the arrangement 461. Attached to the plate 451 is an inverted u-shaped element 452*a* having legs 453, 454 and a connecting member 455.

The member 455 is longer than the width of the plate 451 so that the legs 453, 454 are located externally of the sides of the plate 451 which are engageable with the guides 449*a*–449*d*. The member 455 is attached to the outward facing side of the plate 451 so that respective free ends 455*a*, 456 of the legs 453, 454 are in parallel spaced-apart relationship relative to the external face of the bracket 444*a*. When the pins 460, 460*a* are in position in the slots 445, 445*a* of the bracket 444*a*, the respective ends 455*a*, 456 are in abutting relationship to the respective ends of the pins 460, 460*a* thereby preventing the pins from sliding in the direction of the arrows 470. The ends of the pins 457, 458 may be square shaped in cross section so that the respective sides of the plate 451 which engage with the guides 449*a*–449*d* abut the sides of the square shaped sides of ends 457, 458 of the pins 460, 460*a* thus preventing rotation of the pins 455, 456 in the slots 445, 445*a*.

Figure 20:
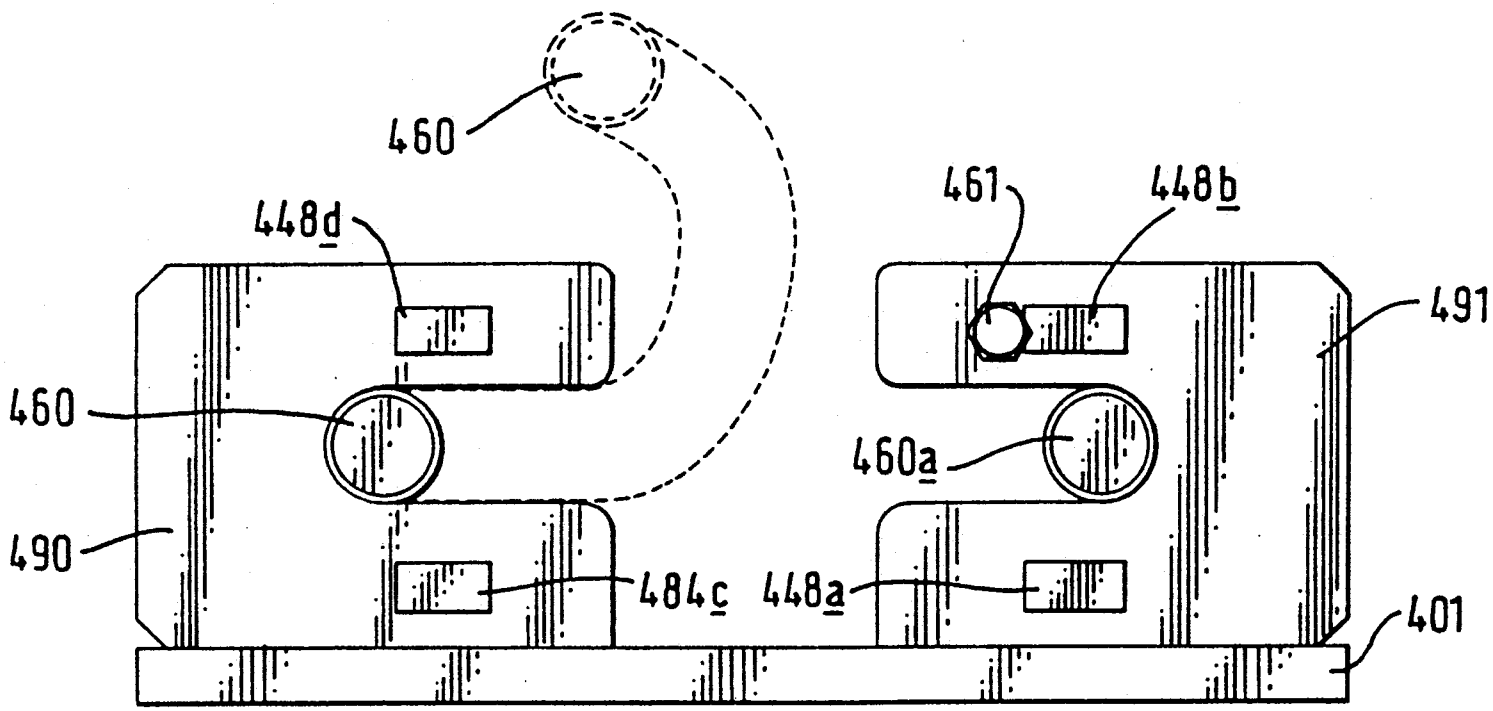
FIG. 20 is an end elevation of part of the connecting means of FIG. 15 of the drawings.

In use, and assuming that the pins 460, 460*a* are mounted on the arm of a backhoe loader, the plates 450, 451 are removed and the first pin 460 offered to the slots 445, 445*a* as shown in dotted outline in FIG. 20 of the drawings. The pin 460 is manoeuvred so as to engage with the, for example, respective left hand inner recesses of the slots 445, 445*a* as shown in solid outline in FIG. 20 of the drawings. The second pin 461 is now offered in a similar manner so as to occupy the respective right hand inner recesses of the slots 445, 445*a*.

When thus positioned, the pins 460, 460*a* may be locked in place by the insertion of the plates 450, 451 as previously described.

If desired, each of the plates 450 451 may comprise two plates 490, 491 as shown in FIG. 20 of the drawings.

The connecting means 400 may be used on other equipment if so desired.

I claim:

1. A vibratory plow assembly comprising: a mounting support frame; a plow blade extending in use generally downwardly from the support frame, the plow blade having a lower end and a leading edge facing in the direction of travel for cutting the ground; a ripper tooth secured to the lower end of the plow blade and extending forwardly from the leading edge; a vibratory means; mans for mounting the vibratory means rearwardly of all portions of said leading edge and for operative association with the support frame; a base member; means located forwardly of said leading edge and the vibratory means and transversely relative to the plane of the plow blade for pivotally connecting the base member to the support frame; means for connecting the base member to a vehicle, said base member and said support frame defining a pair of jaws having a mouth extending rearwardly of the plow blade so that said ripper tooth moves upwardly and forwardly in operation; and biasing means engaging said base member and said support frame for resiliently biasing the base member and support frame apart.

2. An assembly as claimed in claim 1 wherein the means for mounting the vibratory means is a cantilevered support member extending rearwardly of the plow blade.

3. An assembly as claimed in claim 1 wherein the vibratory means is mounted on the support frame.

4. An assembly as claimed in claim 1 wherein the blade is bifurcated to form two spaced-apart rearwardly extending plate members each having a front portion and a rear portion; and guide means for a cable disposed between the plate members for enabling the cable to pass in a rearward direction between the plate members from the upper part of a front portion to the lower part of a rear portion of the plate members.

5. An assembly as claimed in claim 1 wherein the vibratory means is adapted to operate at a frequency of between 5 Hz and 17 Hz.

6. An assembly as claimed in claim 1 wherein the connecting means includes means for enabling the assembly to be supported at one side of the vehicle.

7. A vibratory plow assembly which comprises a mounting support frame, a plow blade extending in use downwardly from the support frame, the plow blade having a leading edge; a vibratory means; means for mounting the vibratory means for operative association with the support frame; a base member; means located forwardly of the vibratory means for pivotally connecting the base member to the support frame; and connecting means for connecting the base member to a vehicle, and wherein the connecting means comprises: a base joined to the base member; the base having two elements in substantially parallel spaced-apart relationship and substantially perpendicular thereto; each of the elements defining a respective slot for the reception of a complementary mounting pin of a vehicle for securing the connecting means to the vehicle; and releasable locking means on said elements for locking the pin in the slot.

8. An assembly as claimed in claim 7 wherein each slot is T-shaped for the reception of two spaced-apart mounting pins mounted on pivotally connected support arms of the vehicle, each slot having a narrow mouth leading to laterally disposed recesses for reception of the pins, and wherein the locking means includes a locking plate engageable between the pins for releasably locking the pins within the recesses.

9. An assembly as claimed in claim 8 wherein the locking plate is provided with means for preventing slideable movement of the pins in the slots in a direction transverse to the elements.

10. An assembly as claimed in claim 9 wherein the locking plate is provided with means for preventing rotation of the pins in the recesses.

11. A vibratory plow assembly comprising:

a mounting support frame;

a plow blade connected to and extending generally downward from the support frame, said plow blade having a leading edge, and said blade being bifurcated to form two spaced-apart rearwardly extending plate members each having a front portion and a rear portion;

a vibratory unit;

means for mounting the vibratory unit for operative association with the support frame;

a base member;

means located forwardly of the vibratory unit for pivotally connecting the base member to the support frame;

cable guide means between the plate members for guiding a cable for passage in a rearward direction between the plate members from the upper part of the front portion to the lower part of the rear portion; and means for connecting the assembly to a vehicle, wherein the connecting means comprises:

a base joined to the base member, said base having two elements in substantially parallel spaced-apart relationship and substantially perpendicular thereto;

each of the elements defining a respective slot for the reception of a complementary mounting pin of a vehicle for securing the connecting means to the vehicle; and releasable locking means on said elements for locking the pin in the slot.

12. An assembly as defined by claim 11 wherein each slot is T-shaped for the reception of two spaced-apart mounting pins mounted on pivotally connected support arms of the vehicle, each slot having a narrow mouth leading to laterally disposed recesses for reception of the pins and wherein said locking means includes a locking plate engageable between the pins for releasably locking the pins within the recesses.

13. An assembly as defined by claim 12 wherein said locking plate is provided with means for preventing slideable movement of the pins in the recesses in a direction transverse to the elements.

14. An assembly as defined by claim 13 wherein the locking plate is provided with means for preventing rotation of the pins in the recesses.

* * * * *